United States Patent [19]

Klefbeck

[11] Patent Number: 4,836,060

[45] Date of Patent: Jun. 6, 1989

[54] ENERGY EFFICIENT CORK EXTRACTOR

[76] Inventor: Robert J. Klefbeck, 3 Dresden Ct., Albany, N.Y. 12203

[21] Appl. No.: 189,476

[22] Filed: May 2, 1988

[51] Int. Cl.[4] ..... B67B 7/02

[52] U.S. Cl. ..... 81/3.29; 81/3.45

[58] Field of Search ..... 81/3.45, 3.37, 3.36, 81/3.29, 3.48

[56] References Cited

U.S. PATENT DOCUMENTS 4,572,034 2/1986 Lee ..... 81/3.45

FOREIGN PATENT DOCUMENTS 68069 1/1983 European Pat. Off. ..... 81/3.09

3048769 7/1982 Fed. Rep. of Germany ..... 91/3.09

*Primary Examiner*—Roscoe V. Parker

*Attorney, Agent, or Firm*—Heslin & Rothenberg

[57] ABSTRACT

A device for providing a simple and effortless removal of a cork or stopper from its container. The present invention comprisess a partially threaded cylindrical shaft, said shaft adapted at one end to support a pin placed through and protruding from its diameter. The shafts opposite end is provided with a common cork-screw tip and a ball shaped housing to accomodate varying container rims. A threaded and slotted ball is used to communicate with said pin and shaft threadings, whereby a continuous clockwise rotation of the ball, penetrates and removes the cork or stopper.

6 Claims, 1 Drawing Sheet

ENERGY EFFICIENT CORK EXTRACTOR

BACKGROUND ART

Numerous devices have been appropriated for the purpose of removing a plug or stopper from common liquid containers. The inventions that reside in this art depend on various physical and mechanical procedures to accomplish what should be a simple and effortless operation. Many of the aforesaid devices apply various attitudes of leverage, prying and pulling type motions that complicate the act of extracting a cork or stopper from its container. Some other devices depend on elaborate mechanical systems, one of which, while installing its corkscrew, raises two arms approximately 170 degrees, said arms are then used as levers to pull the cork or stopper from the bottle. This device, although respectfully adequate, is dependent on a two handed lever system, which correctly operates only upon a full penetration of the cork or stopper. This deep penetration allows cork particles or fragments to enter and violate the contents of the bottle; said extensive penetration of the cork, also disallows an easy removal of the cork from the corkscrew, after the operation is completed. Additional devices in this art operate with the use of gas or air pumps. The use of these pumps, are noted by wine manufacturers, to aerate and lessen the quality of the containers contents. It has become apparent, that the instruments in this art have provided some room for improvements. Generally, the present invention utilizes a threaded cylindrical shaft in conjunction with a threaded ball, to install the corkscrew and remove the cork by means of applying a simple continuous clockwise rotation of said ball. The problem solving achievements of this new device are many fold. For example, the present invention requires only a partial penetration of the cork, thus eliminating cork fragments from entering and effecting the quality of the containers contents, this also allows an easy removal of the cork from the corkscrew after the removal procedure is completed. A second problem solved, is that of relieving its user of the stressful requirements of lever, prying and pulling actions, while applying only a one handed, effortless, clockwise rotation of said ball. Since air or gas pumps are no longer required to achieve an effortless extraction of the cork or stopper, the previous stated aerating problem has been resolved by the present invention. The present invention has also replaced elaborate mechanical systems with simple cooperating threaded components.

SUMMARY OF THE INVENTION

It is a major objective of the present invention to provide a cork or stopper extractor which in general, utilizes a threaded cylindrical shaft, adapted to support a common corkscrew tip and a threaded ball, so as to allow for a simple physical and mechanical extraction, in that a continuous clockwise rotation of the ball, penetrates and removes the cork or stopper. A second major objective is to provide an improved cork extractor, whereby the ease of the removal procedure, does not sacrifice the quality of the containers contents, such as aerating factors and cork fragments participating in the product of the bottles. Generally, the objectives of this invention are carried out by providing a threaded cylindrical shaft adapted at an end, to support a common corkscrew tip. The opposite end of the shaft incorporates diminishing threadings, at which point a pin is placed through, and protrudes from the shafts diameter. A hollow bell shaped housing is adapted to move freely along the length of the threaded shaft, and conform to varying sized container rims. The cylindrical shaft threadings are to accept the threadings of a ball, said ball is also provided with a slot, to communicate the said pin. Upon the ball and pin involvement, a clockwise rotation of the ball is initiated, thus rotating the entire threaded cylindrical shaft and its accompanying corkscrew tip, thus installing the corkscrew in the cork. While rotating, the ball is pushed downward slightly to depart from the pin, and begin its engagement with the threadings of said cylindrical shaft, whereby a continuation of the balls clockwise rotation allows a resistance to embody the bell shaped housing and container rim, thus in opposition, the threaded cylindrical shaft is drawn up and through the threadings of said ball, resulting in a simple and effortless removal of a cork or stopper from its container. A spring may be optionally placed along the threaded cylindrical shaft, and positioned atop the bell shaped housing to assist in the cork removal operation, by applying its stored contracted energy to the ball and threaded cylindrical shaft, said springs contraction is made allowable by its positioning between the bell shaped housing and the descending rotating ball.

Providing this one handed, one way rotation, single mode operation, is still another objective of this invention, whereby amputees, unskilled, and otherwise handicapped persons may utilize these advantages.

This and other objects, features and advantages of the present invention will become more apparent in the following description of a preferred embodiment with reference to the accompanying drawing, in which

DETAILED DESCRIPTION OF THE PREFERRED EMBODIMENT

Figure 1:
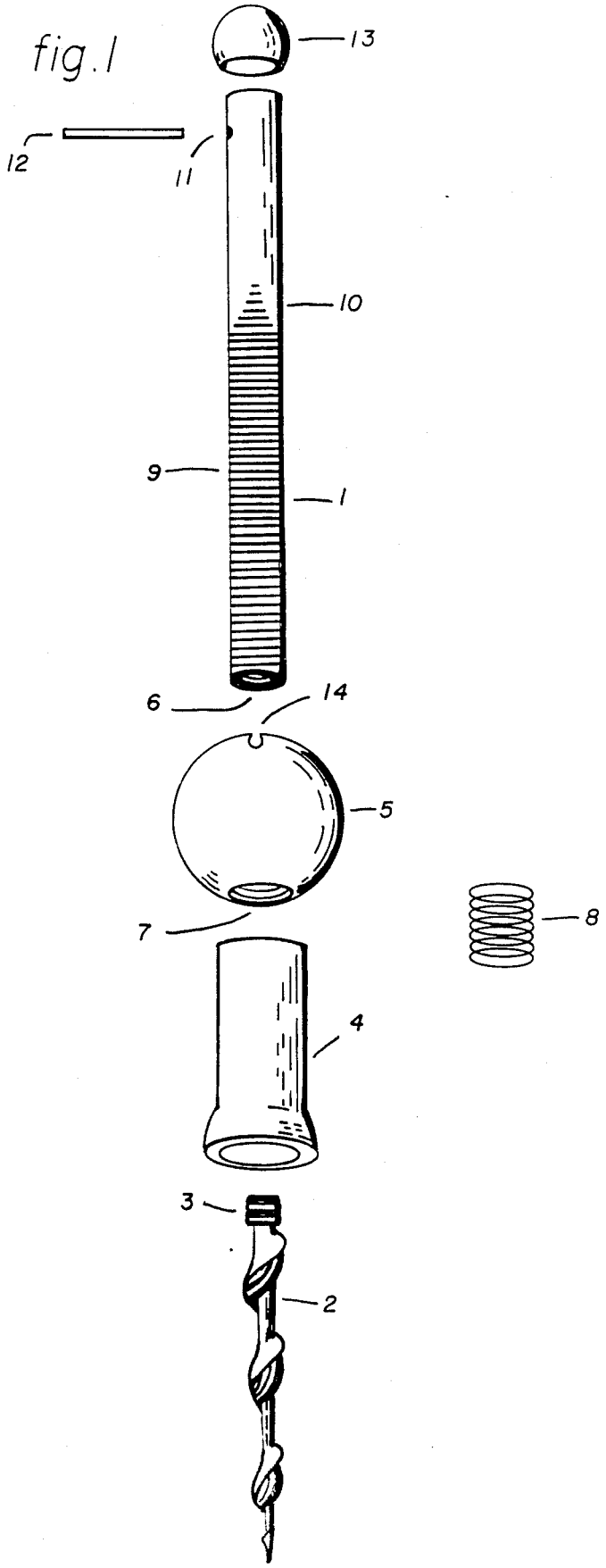
FIG. 1 is a side view of the components comprising the invention. Included and offset are a pin and a spring.

In reference to FIG. 1, in this a side view of the invention, the present cork extractor comprises a cylindrical shaft denoted by numeral 1 preferably composed of a lightweight plastic or nylon material. Threadings 9 begin at an end and run along the exterior of cylindrical shaft 1, to a location denoted by numeral 10 where threadings diminish to a nonexisting state. A lightweight plastic or nylon ball 5 has been appropriated with interior threadings 7, said threadings are to pass completely through its diameter or center, said threadings 7 are to also cooperate with exterior shaft threadings 9. The cylindrical shaft 1 also incorporates interior threadings, represented by numeral 6, interior threads 6 are to accept exterior threadings 3 of a common corkscrew tip 2, thus connecting the cylindrical shaft 1 with the common corkscrew tip 2. Near an opposite end of the cylindrical shaft a hole 11 is placed, which extends through the shafts diameter, hole 11 is to receive and support a pin 12, said pin 12, preferably being of a hard enduring material, passes through the shafts diameter and is situated here with equal protrusions at its points of entry and exit. Ball 5 having a groove or indentation 14, is to slide along the diminishing thread portion 10 of the cylindrical shaft 1, said groove or indentation is shaped and sized to grasp the protruding portions of pin 12. Upon the union of ball 5 with pin 12, a clockwise rotation of the ball is commenced, thus rotating the entire threaded cylindrical shaft and its accompanying corkscrew tip 2, resulting in an installation of the corkscrew tip in the cork. While rotating, ball 5 is pushed downward slightly to depart from pin 12, and begin its engagement with threadings 9 of cylindrical shaft 1, whereby a continuation of the balls clockwise rotation allows a resistance to embody a bell shaped housing 4 and a containers rim, said housing 4 is adapted to move freely along the length of cylindrical shaft 1 and conform to varying sized container rims, in opposition to said resistance, the threaded cylindrical shaft 1 is drawn up and through threadings 7 of said ball 5, resulting in a simple and effortless removal of a cork or stopper from its container. It should be noted that a common spring denoted by numeral 8 may be optionally placed along the cylindrical shaft 1 and positioned between ball 5 and bell shaped housing 4, so as clockwise rotating ball 5 compresses spring 8, thus an upward force is applied to the ball and the threaded cylindrical shaft, resulting in a second and separate extracting energy to the cork or stopper. A rubber pad 13 may also be optionally placed atop cylindrical shaft 1, said pad 13 is used as a hand cushion for applying a downward pressure to initiate cork penetration of the corkscrew tip. It should also be noted that this present device does not rely on a full penetration of the cork, to place mechanical components in proper operating positions, therefore necessary rotations of ball 5 are limited, while not jeopardizing a firm installation of the corkscrew. It is understood that changes and modifications in the specifically described embodiment can be carried out without departing from the scope of the invention which is intended to be limited only by the scope of the appended claims.

What is claimed is:

1. A cork or stopper extractor which comprises:

a partially threaded cylindrical shaft, a ball having an internally threaded bore sized to accept said shaft threadings, said ball also being provided with means to grasp the extremities of a pin, said pin being positioned at the threadless portion of the shaft's end and placed through and extending from the shaft's diameter, a common corkscrew tip attached to said shaft's opposite end;

a threadless tubular housing adapted to move freely along the length of said shaft and having one end designed to conform to varying sized container rims;

a common spring is provided and positioned between said tubular housing and said ball;

whereby upon the ball and pin involvement, a limited clockwise rotation of said ball is initiated, thus rotating the entire threaded cylindrical shaft and its accompanying corkscrew tip, resulting in a partial installation of the corkscrew in the cork; while rotating, said ball is pushed downward slightly to disengage from said pin and begin a communication with said cylindrical shaft threadings, a continuation of said clockwise ball rotation allows a resistance to embody said tubular housing and the container rim, thus in opposition, said threaded cylindrical shaft and its accompanying corkscrew tip are drawn upwards to provide a simple and effortless cork or stopper extraction.

2. A cork extractor comprising:

a cylindrical shaft, said shaft being threaded at one end and substantially smooth at the other end;

a first member having at threaded internal bore sized to threadably engage said cylindrical shaft threads, said smooth cylindrical shaft end being sized to allow said first member to slidably move thereon;

means for engageably retaining said member at said smooth cylindrical shaft end;

a second member having a bore therethrough sized to allow said second member to move freely along said cylindrical shaft and to at least partially receive a bottle cork, said second member having one end adapted to engage the top of a bottle and its opposite end designed to engage said first member; and said threaded cylindrical shaft end having a corkscrew tip secured thereto, whereby in use said first member is initially retained at said smooth cylindrical shaft end by said engagement means with said corkscrew tip engaging the bottle's cork and rotated such as to drive said corkscrew tip into the cork, said first member is then disengaged from said engagement means and rotated to threadably engage the threaded end of said cylindrical shaft portion until said first and second member are in opposition, and the resistance created therebetween by continued turning of said first member drives said cylindrical shaft upwards through said first and second member thereby removing the cork and corkscrew tip from the bottle.

3. The cork extractor of claim 2, wherein said first member comprises a ball-shaped housing and said second member comprising a hollow bell-shaped housing.

4. The cork extractor of claim 3, wherein said engagement means comprises a pin having first and second portions diametrically extending from said cylindrical shaft and said ball-shaped housing has a slot positioned and sized to releasably engage said extending pins.

5. The cork extractor of claim 4, wherein said cylindrical shaft includes a region of diminishing threads between said threaded end portion and said smooth end portion.

6. The cork extractor of claim 4, further comprising a spring positioned between said first member and said second member to enhance compressive forces therebetween when said extractor is in use to remove a cork from a bottle, thereby facilitating removal of the cork.

* * * * *